United States Patent [19]

Dougherty

[11] 4,019,231

[45] Apr. 26, 1977

[54] METHOD FOR ATTACHING A SHADOW OR PHOTOGRAPHIC MASK TO A FLANGELESS, CURVED FACEPLATE OF A COLOR TELEVISION PICTURE TUBE

[75] Inventor: Lawrence W. Dougherty, Sleepy Hollow, Ill.

[73] Assignee: Zenith Radio Corporation, Glenview, Ill.

[22] Filed: July 6, 1976

[21] Appl. No.: 702,822

[52] U.S. Cl. ..... 29/25.15

[51] Int. Cl.[2] ..... H01J 9/18

[58] Field of Search ..... 29/25.13, 25.15, 25.16, 29/464, 521

[56] References Cited

UNITED STATES PATENTS

| | | | |
|---|---|---|---|
| 3,838,483 | 10/1974 | Baranski et al. | 29/25.15 |
| 3,894,260 | 7/1975 | Sediry | 29/25.15 |
| 3,978,562 | 9/1976 | Polar | 29/25.15 |

*Primary Examiner*—Richard B. Lazarus
*Attorney, Agent, or Firm*—John R. Garrett

[57] ABSTRACT

This disclosure depicts a method, for use in the manufacture of color television picture tubes, for attaching a frameless, curved, non-self-rigid shadow or photographic mask to a flangeless, curved faceplate, the faceplate having a concave inner surface with mask support studs extending therefrom in corner regions thereof. The method comprises providing on each corner of the mask a leaf-type spring having a stud engagement provision for retentively engaging a mating provision on one of the studs. The leaf-type spring also has indexing means separate from the stud engagement provision. The mask is supported in a substantially horizontal position, with the faceplate also being supported in a substantially horizontal position such that the concave surface of the faceplate faces a convex surface of the mask. The faceplate and the mask are rotationally and translationally aligned by engaging the studs on the faceplate with a stud aligning means such that the mating provisions on the stud lie in a substantially horizontal, predetermined stud reference plane, and by engaging the indexing means on the spring with a spring aligning means such that the stud engagement provisions lie in a substantially horizontal, predetermined spring reference plane. The spring reference plane is spaced a predetermined distance in a substantially vertical direction from the stud reference plane. The springs are depressed with the spring aligning means. Translational, relative motion is effected over the predetermined distance between the faceplate and mask assembly such that the stud reference plane and the spring reference plane coincide. The springs are released such that the stud engagement provisions on the springs engage the mating provisions on the stud.

5 Claims, 14 Drawing Figures

METHOD FOR ATTACHING A SHADOW OR PHOTOGRAPHIC MASK TO A FLANGELESS, CURVED FACEPLATE OF A COLOR TELEVISION PICTURE TUBE

CROSS REFERENCE TO RELATED APPLICATIONS

This application relates to, but is no way dependent upon, U.S. Patents and copending application of common ownership herewith, including: U.S. Pat. Nos. 3,912,963 issued Oct. 14, 1975, 3,838,483 issued Oct. 1, 1974, 3,894,260 issued July 8, 1975 and 3,943,399 issued Mar. 9, 1976; and copending applications, Ser. No. 535,614 filed Dec. 23, 1974 (now U.S. Pat. No. 3,975,198), Ser. No. 634,201 filed Nov. 21, 1975, Ser. No. 603,973 filed Aug. 12, 1975, Ser. No. 603,975 filed Aug. 12, 1975 now U.S. Pat. No. 3,999,098, Ser. No. 603,984 filed Aug. 12, 1975 now U.S. Pat. No. 3,986,072, Ser. No. 527,001 filed Nov. 25, 1974 and Ser. No. 702,823 filed July 6, 1976.

BACKGROUND OF THE INVENTION

Conventional color cathode ray tubes are constructed of several major components including a shadow mask, a flanged glass faceplate, and a glass funnel-like envelope which is a frit-sealed to the faceplate. The faceplate has a number of shadow mask support studs embedded in its flange and the mask assembly includes a corresponding number of springs. Each spring has an alignment hole in one end thereof for engagement with a faceplate stud.

When the tube has been assembled, the shadow mask is attached to the faceplate and securely fastened thereto by the engagement of the faceplate studs with the mask spring holes. Thus, the mask assembly can be removed from the faceplate by compressing the leaf springs and disengaging the studs from the holes.

In the production of cathode ray tubes, in the process of establishing a tricolored phosphor pattern on the faceplate inner surface, the faceplate is first coated with a photosensitized phosphor slurry, the mask is attached to the faceplate, and a source of actinic light is directed through the mask apertures. Those preselected areas of the phosphor coating which are thus exposed to the actinic light are rendered insoluble in water while the nonexposed areas remain soluble. During this exposure, the mask must be securely attached to the faceplate.

The next processing step is to remove the mask from the faceplate and treat the exposured faceplate surface with a solvent to wash away the soluble slurry from those areas of the mask which have not been exposed. The result is a faceplate covered with an array of phosphor elements which corresponds to the aperture array of the mask. Each faceplate is mated with a particular mask to insure that the pattern of apertures in the mask corresponds precisely to the phosphor pattern deposited on the rear surface of the faceplate.

This entire procedure must be repeated for each of the three colored phosphors. Obviously, the shadow mask must be inserted into the faceplate and removed therefrom several times during the processing of the faceplate. Because the mask is only seven mils thick, it is easily dented and mis-shapen by accidental bumping and mishandling. Should a shadow mask become bent or dented, it and its corresponding faceplate must be scrapped because even small dents can cause substantial misregistration between the phosphor pattern on the faceplate and the aperture pattern on the mask.

Instead of using a shadow mask for exposure of the phosphor slurry, a single photographic mask may be used for exposure of many faceplates. Such a photographic mask is disclosed in copending applications Ser. No. 535,614 filed Dec. 23, 1974 (now U.S. Pat. No. 3,975,198) and claimed in copending application Ser. No. 643,201 filed Nov. 21, 1975, both assigned to assignee of the present application.

It has in the past been common to have the masks inserted and removed from their respective faceplates manually. This manual insertion and removal of the mask is not only time consuming but gives rise to mishandling. In addition, since the faceplate is normally in a horizontal position with its phosphor coating surface facing upwardly during insertion and removal of the panel, it is possible for human hair, lint, etc. to fall onto the mask or onto the faceplate itself. Such undesirable elements tend to contaminate either the mask or the faceplate and can result in a subsequently rejected cathode ray tube.

To overcome the inherent difficulties of manual attachment of the aperture mask to the faceplate, it is desirable to have means for automatically effecting such attachment. While the likely benefits of automatic mask attachment have been long appreciated, few commercially practical apparatus for accomplishing it have been made. Part of the problem with effecting the automatic machine attachment of a mask to a faceplate arises because of the fact that each mask spring hole should be in precise registry with its mating faceplate stud before they may be properly engaged. However, the holes and studs for a particular mask faceplate pair are not precisely enough located on their respective supporting structures to permit a machine to perform a standard attachment maneuver and guarantee that each mask faceplate pair will be properly mater. This problem, in addition to the requirement that an automatic machine attachment device be fast enough to keep up with other cathode ray tube production equipment, has forestalled the use of such devices in commercial production applications.

U.S. Pat. No. 3,838,483, issued to Ronald S. Baranski and Leslie L. Baur and issued to the assignee of this application, discloses and claims apparatus and method for the automatic insertion of a cathode ray tube shadow mask into a mating front panel having a wrap-around flange. The apparatus includes means for aligning the shadow mask such that the mask alignment holes in the springs are positioned at points which lie in a substantially horizontal hole reference plane with each hole positioned at a predetermined location, and means for engaging the panel studs and aligning the panel by means of the studs to a position where the studs are located at points which lie in a substantially horizontal stud reference plane and at a location within that plane which places each stud in vertical alignment with and at a predetermined distance above its corresponding mask alignment hole. With the shadow mask and its panel in position of alignment, the mask springs are compressed to permit insertion of the mask assembly into the panel, the mask is raised the predetermined distance between the hole reference plane and the stud reference plane, and the springs are released to permit engagement between each stud and its corresponding alignment hole.

The apparatus disclosed in the Baranski and Baur patent utilized the mask-spring holes to position the mask. This is cumbersome since the engaging instrumentality must get out of its own way to permit stud engagement in the spring hole. Additional mechanisms are required to permit the instrumentality to be removed without losing the reference position of the mask which the instrumentality determined.

The invention of the present application is believed to be most useful when applied to a unique tube having a flangeless faceplate. Such a tube is disclosed in U.S. Pat. No. 3,894,260, issued to the assignee of this application. The tube has a flangeless, curved glass faceplate, a concave inner surface of which receives a phosphor screen. The funnel portion of this unique tube has a convex curved seal land (that is, the seal land defines a convex curved plane) which matches and mates with the curvature of the concave inner surface of the faceplate. Since the faceplate is flangeless, the sealing interface between the funnel and faceplate is curved rather than planar as in conventional tubes.

The use of a flangeless faceplate poses new problems in automatically attaching the shadow or photographic mask to the faceplate. The apparatus and method of U.S. Pat. No. 3,838,483 for use with a flanged faceplate rely on the presence of the flange for attachment of the shadow mask to the faceplate and utilizes the spring holes for positioning the mask. The method of this invention overcomes the problems indicated above and permits the automatic attachment of a shadow or photographic mask to a flangeless faceplate.

OTHER PRIOR ART

U.S. Pat. No. 3,482,286 issued to G. L. Fassett et al., and U.S. Pat. No. 3,653,112 issued to C. L. Smith et al.

OBJECTS OF THE INVENTION

It is a general object of this invention to provide a method useful in the manufacture of shadow mask type color cathode ray tubes having a flangeless faceplate, in particular, a method for attaching the shadow or photographic mask to the faceplate.

It is a more specific object of this invention to provide a method capable of effecting rapid and precise automatic mask to faceplate attachment.

BRIEF DESCRIPTION OF THE DRAWINGS

The features of this invention, which are believed to be new are set forth with particularity in the appended claims. The invention, together with further objects and advantages thereof, may best be understood by reference to the following description in conjunction with the accompanying drawings in which like reference numerals refer to like elements and in which:

DESCRIPTION OF THE PREFERRED EMBODIMENT

Whereas the method of this invention may be used in the manufacture of color cathode ray tubes of various types, it is preferably used in the manufacture of a tube having an envelope comprising a funnel and a flangeless faceplate. The unique construction of the faceplate without a flange permits ecomomies in the manufacture of the envelope, and simplified and economical screening and assembly processes. The faceplate has a curved configuration which may be spherical, multiradial, cylindrical, or of other suitable curvature. The faceplate has a convex front surface connected to a concave rear surface by a peripheral edge surface. The edge surface is contoured, that is, the edge surface portions along sides of the faceplate depart from and return to a plane connecting the four corners of the faceplate.

The funnel has a convex seal land, herein intended to mean a seal land which lies on an imaginary curved surface, which surface curvature may be spherical, multi-radial, cylindrical, or of other suitable curved configuration. The seal land of the funnel is curved to match and mate with the concave rear surface of the faceplate along a sealing interface. The seal land of the funnel is hermetically bonded to the rear surface of the faceplate by a devitrifying glass solder.

The concave rear surface of the faceplate may be slightly larger than the wide end of the funnel to which the faceplate is attached. Thus, when the tube is assembled, the faceplate overhangs the funnel slightly. Alternatively, the faceplate edge surface may be flush with the outside surface of the funnel.

Figure 1:
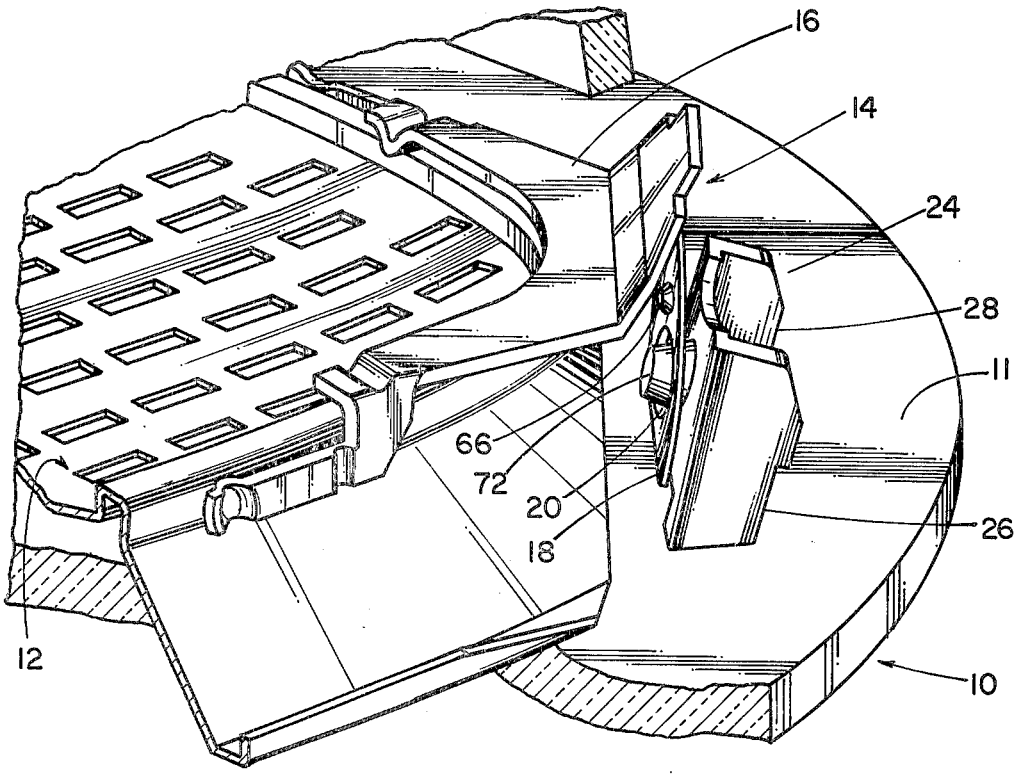
FIG. 1 is a fragmentary perspective view of a suspension system for supporting a shadow or photographic mask in spaced adjacency to a flangeless faceplate.
Figure 2:
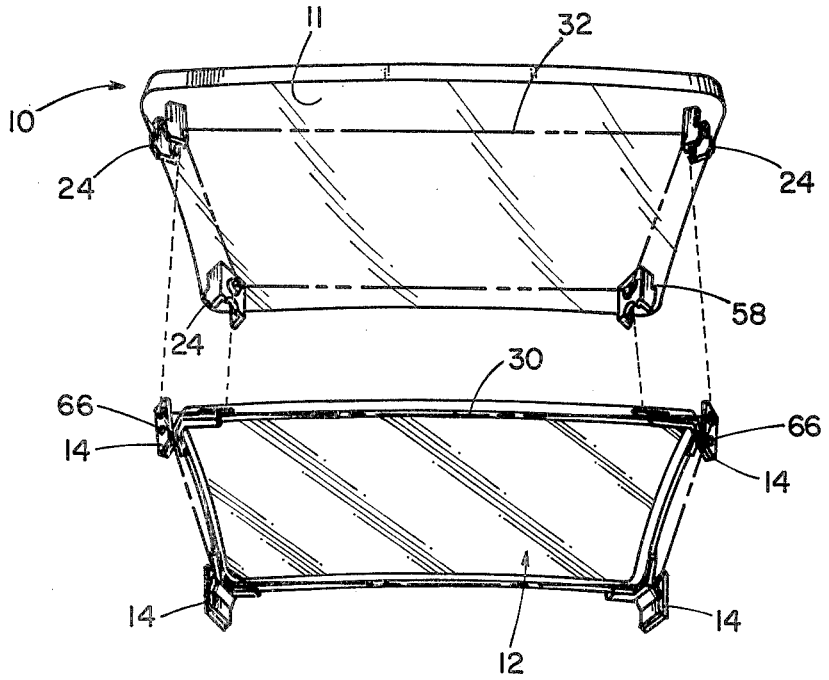
FIG. 2 is a schematic, exploded perspective view of a faceplate and shadow mask shown in part in FIG. 1.

A suspension system of unique construction is illustrated in FIGS. 1–2 and provides for supporting a shadow mask 12 in spaced adjacency to a rear surface 11 of a flangeless faceplate 10. (A shadow mask is shown for purposes of illustration, although the invention of the present application can be used for photographic mask.) The suspension system shown is not the subject of this application, being described and claimed in the following U.S. Pat. Nos. 3,890,526 and 3,943,399, and copending applications Ser. No. 675,653 filed Apr. 4, 1976 and Ser. No. 603,973 filed Aug. 12, 1975, all assigned to the assignee of the present application.

The suspension system preferably comprises four suspension devices 14, one at each corner of mask 12. The shadow mask 12 is constructed so as to be relatively rigid with respect to its major and minor axes, but less rigid with respect to its diagonals. By mounting the suspension devices 14 at the corners of the mask 12, unit-to-unit deviations in the faceplate 10 with respect to the faceplate diagonals are followed by corresponding flexure of the shadow mask 12 so as to maintain a constant Q spacing, i.e., a constant spacing between the central apertured portion of the shadow mask 12 and the rear surface 11 of the faceplate 10. The shadow mask 12 is disclosed and claimed in U.S. Pat. No. 3,912,963, which is assigned to the assignee of the present application.

Although numerous other arrangements are contemplated, in the illustrated preferred suspension system, the suspension devices 14 each comprise a bracket 16 mounted on a corner of the mask 12. The bracket 16 carries a leaf spring 18 which is relatively weak, but laterally stiff (in its own plane and in torsion). The spring 18 carries on its distal end an apparatus 20 which mates with a protrusion 22 on a faceplate-mounted shadow mask support stud 24 when the mask 12 is mounted in its operative position on the faceplate 10. Alternatively, a protrusion may be carried by the spring with the stud having an aperture (see stud 58 in FIG. 2). In general, the spring 18 is said to have a stud-engagement provision for retentively engaging a mating provision on the stud 24. To insert or remove the mask 12, the springs 18 are depressed by utilizing indexing means 66 until the stud-engagement provisions are clear of the mating provision on the studs 24. The brackets and springs are disclosed and claimed in the following copending applications, all assigned to the assignee of the present application:

Ser. No. 603,975 filed Aug. 12, 1975;
Ser. No. 603,984 filed Aug. 12, 1975; and
Ser. No. 603,973 filed Aug. 12, 1975.

The stud 24 has a channel shape with a face containing the mating provision and two legs 26 and 28. The two legs 26, 28 are embedded in (or may be cemented to) the faceplate 10. The spaced legs 26, 28 permit screening fluids suffused across the faceplate 10 to pass through the stud 24 without clogging it. The recess in the stud 24 is for clearance of a spring aligning means described below.

The studs on the faceplate establish the position of the faceplate relative to the funnel by engaging channel shaped notches in the corners of the mouth of the funnel when the faceplate and funnel are assembled. The funnel notches are disclosed and claimed in copending application Ser. No. 527,001 filed Nov. 25, 1974, which is assigned to the assignee of the present application.

It is important to note that each of the stud engagement provisions on the leaf springs 18 lie in a common flat plane 30, here called a spring reference plane. Similarly, the mating provisions of the stud 24 lie in a common flat plane 32 here termed a stud reference plane. When the stud reference plane coincides with the spring reference plane, the stud engagement provisions of each of the springs is in alignment with mating provision on each of the studs so that engagement may take place.

Figure 3:
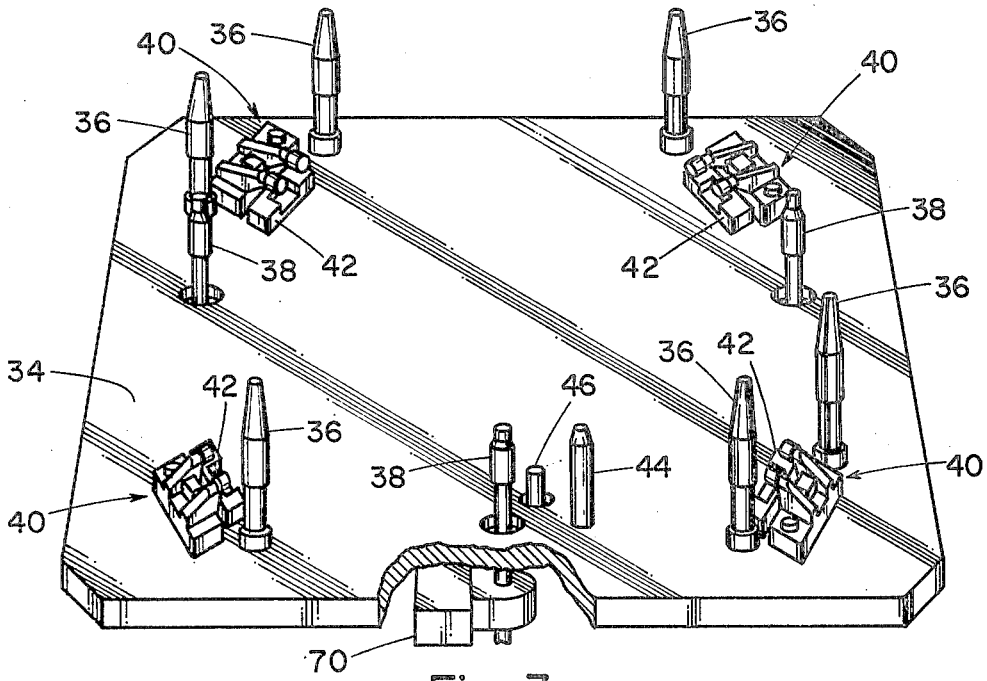
FIG. 3 is a schematic perspective view of apparatus for implementing the method of the present invention.
Figure 4:
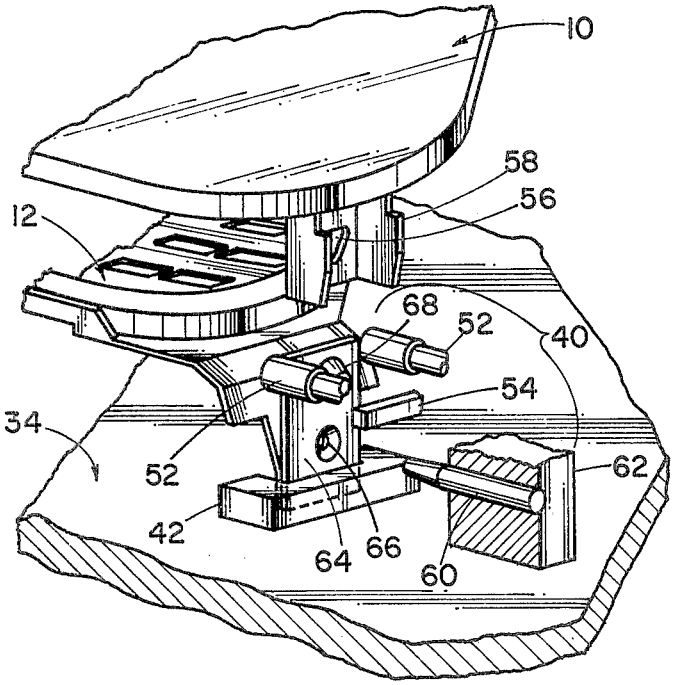
FIG. 4 is a fragmentary perspective view showing a faceplate and mask positioned on the FIG. 3 apparatus.

FIGS. 3 and 4 show apparatus for implementing the method of the present invention. The apparatus comprises a table 34 from which project faceplate guide posts 36, between which posts are faceplate support legs 38. The support legs 38 are capable of raising or lowering the faceplate in a vertical direction. Corner assemblies 40 provide a mechanism for the attachment of the mask to the faceplate and will be described in detail below.

In preparation for the insertion of a mask 12 into a faceplate 10, a mask 12 is set on the table 34 such that its leaf-springs and brackets are captured by U-shaped holders 42. The faceplate 10 is then placed in an initial position between posts 36 and rests upon support legs 38. The U-shaped holders 42 and the posts 36 roughly position the mask 12 and the faceplate 10, respectively. A plunger-type faceplate sensing switch 44 indicates to the apparatus that a faceplate is in position. Similarly, a shadow mask sensing switch 46 indicates to the apparatus the presence of a shadow mask.

With the mask 12 in position on table 34, the placement of the faceplate 10 on the support legs 38, contacting sensing switch 44, automatically initiates the apparatus to insert the mask 12 into the faceplate 10. The controlling electronics (not shown) for the apparatus are constructed such that a faceplate with a mask already attached to it will not trigger the apparatus to insert another mask.

One of the four corner assemblies 40 is shown in more detail in FIG. 4. A faceplate 10 is in position and a mask 12 is also in position supported on table 34 and roughly positioned by U-shaped holder 42. A pair of rollers 52 and a stop 54 form a stud aligning means. The support legs 38 are lowered causing the faceplate 10 to engage and be supported by the stud aligning means and causing the faceplate 10 to be rotationally and translationally positioned. As a result, the mating provision 56 on the stud 58 lies in a predetermined stud reference plane which is substantially horizontal. A plunger 60 attached to a translatable holding means 62 forms a spring aligning means. The plunger 60 positions a spring 64 on the mask 12 by engaging an indexing means 66 provided on the spring 64. When the plunger 60 moves radially inward and engages the indexing means 66 on the spring 64, the spring 64 is aligned such that stud engagement provision 68 lies in a predetermined spring reference plane, which plane is substantially horizontal and which is spaced a predetermined vertical distance below the stud reference plane.

The method of this invention will now be described in general terms. The method is for use in the manufacture of color television picture tubes for attaching a frameless, nonself-rigid shadow or photographic mask to a flangeless faceplate, the faceplate having a concave inner surface with mask support studs extending therefrom in corner regions thereof. The method comprises providing on each corner of the mask a leaf-type spring having a stud engagement provision for retentively engaging a mating provision on one of the studs. The leaf-type spring also has indexing means separate from the stud engagement provision. The mask is supported in a substantially horizontal position with the faceplate also being supported in a substantially horizontal position such that the concave surface of the faceplate faces a convex surface of the mask. The faceplate and the mask are rotationally and translationally aligned by engaging the studs on the faceplate with a stud-aligning means such that the mating provisions on the studs lie in a substantially horizontal, predetermined stud reference plane; and by engaging the indexing means on the springs with a spring aligning means such that the stud engagement provisions lie in a substantially horizontal, predetermined spring reference plane. The spring reference plane is spaced a predetermined distance in a substantially horizontal, predetermined distance in a substantially vertical direction from the stud reference plane. The springs are depressed with the spring aligning means. Translational, relative motion is effected over the predetermined distance between the faceplate and mask assembly such that the stud reference plane and the spring reference plane coincide. The springs are released such that the stud engagement provisions on the screens engage the mating provision on the stud.

Figure 5A:
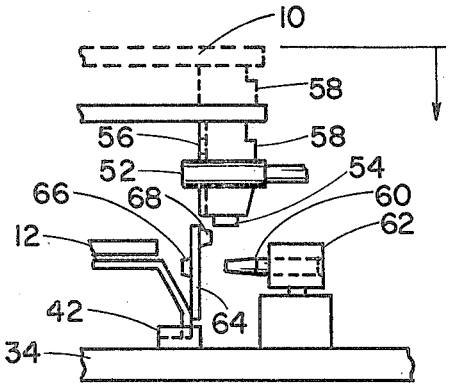
FIGS. 5A–5E schematically illustrate the method of the present invention for attaching a mask to a flangeless faceplate.
Figure 5B:
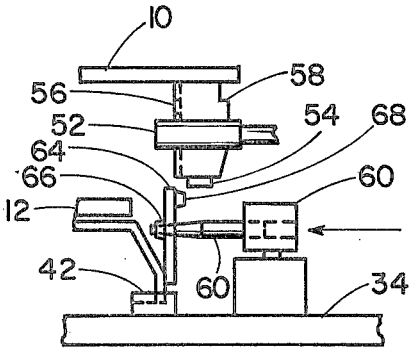

An embodiment of the method of this invention will now be described and is illustrated in FIGS. 5A to 5E. FIG. 5A shows the faceplate 10 and the mask 12 in position in the apparatus and ready for the mask 12 to be attached to the faceplate 10. The schematic cross-sectional view of FIG. 5A is of the same structure shown in perspective in FIG. 4. FIG. 5A shows the faceplate 10 having been lowered by means of the faceplate support legs 38 shown in FIG. 3, so that the stud 58 has engaged the stud aligning means; that is, stud 58 has traveled between the pair of rollers 52 and has come to rest on stop 54.

It should be understood, or course, that each of the studs 58, 24 in the four corners of the faceplate 10 engage similar stud aligning means so that the entire faceplate 10 is now rotationally and translationally aligned; that is, the mating provision on the studs 58, 24 lie in a predetermined rotational position in a substantially horizontal, predetermined stud reference plane. In a preferred embodiment three of the four springs have apertures with a fourth spring 64 having a protrusion. Correspondingly, three of the four studs have protrusions and the fourth stud 58 has an aperture, the protrusions mating with the apertures, as disclosed and claimed in a pending application Ser. No. 603,973 filed Aug. 12, 1975 assigned to the same assignee as the present application.

Figure 5C:
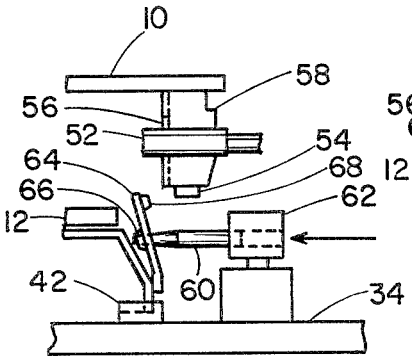
Figure 5D:
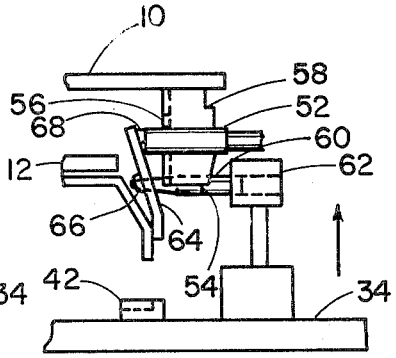

FIG. 5C shows the plunger 60 moved radially inwardly so that it contacts an indexing means 66 on the spring 64, the indexing means 66 here shown as being a recess in the spring 64. With the insertion of the plunger 60 into the indexing means 66 the mask 12 is aligned such that the stud engagement provision 56 lies in a predetermined rotational position in a substantially horizontal, predetermined spring reference plane. This spring reference plane is spaced a predetermined distance in a substantially vertical direction from the stud reference plane; that is, each spring lies directly below its corresponding stud. Plunger 60 continues to travel inwardly in a radial direction such that it depresses spring 64 (FIG. 5C).

Figure 5E:
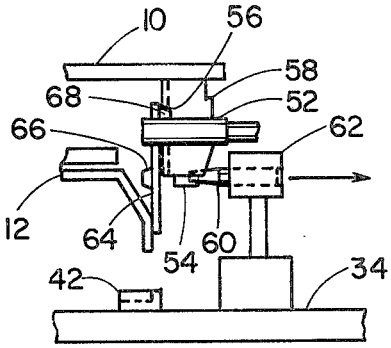

Translatable holding means 62 now raises spring 64 until the spring reference plane coincides with the stud reference plane (FIG. 50). Naturally, this takes place in all four corner assemblies 40 concurrently. Plunger 60 now moves outwardly in a radial direction, as shown in FIG. 5E, and thus releases spring 64 such that the stud engagement provision 68 engages the mating provision 56 on the stud 58. After the springs 64 are released, the faceplate 48 with attached mask 12 is raised to the position it initially occupied in FIG. 5A. The assembled faceplate 10 and shadow mask 12 may now be removed from the apparatus.

To insure full engagement of the stud engagement provision on the leaf-type spring 64 with the mating provision on the corresponding stud 58, one of the support posts 38 in FIG. 3 is subjected to a vibration as the assembled faceplate 10 and mask 12 are raised to the initial position. The vibration causes the protrusion on the spring 64 (or stud) to fully seat in the aperture in the stud 58 (or spring) and thus always occupy the identical position of previous insertions. As was pointed out in the Background of the Invention, this is important in the application of the three different phosphors to the inner surface of the faceplate 10. The vibration of the faceplate is specifically disclosed and claimed in copending application Ser. No. 702,823 filed July 6, 1976 and is assigned to the assignee of the present application.

A magnetic vibrator 70 is shown in FIG. 3 magnetically coupled to support post 38. As a faceplate 10 is raised from the stud aligning means, the support post 38 coupled to the magnetic vibrator 70 vibrates at a frequency of approximately 7200 cycles per minute in a longitudinal direction. The amplitude of vibration is approximately 0.025 inches.

Figure 6A:
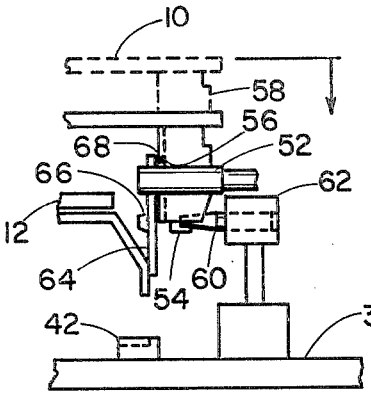
FIGS. 6A–6E schematically illustrate how the FIG. 3 apparatus may be used according to the present invention to remove a mask from a flangeless faceplate.
Figure 6B:
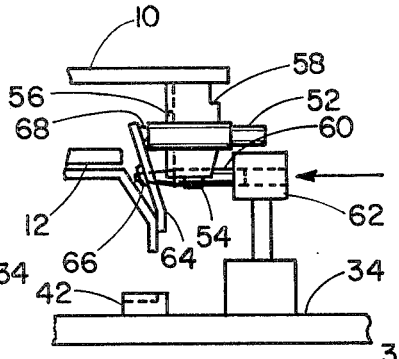
Figure 6C:
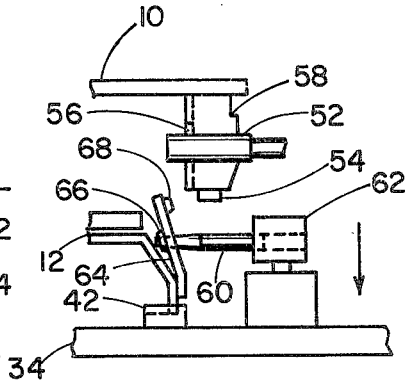
Figure 6D:
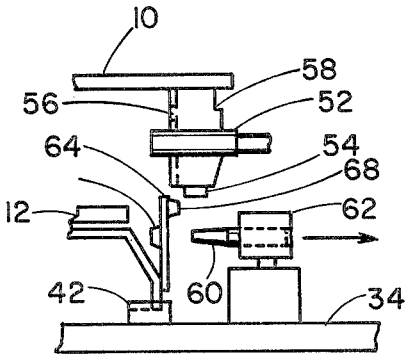
Figure 6E:
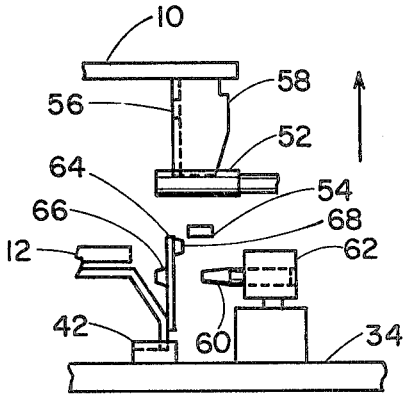

By reversing the steps for insertion the same apparatus may be used for removing a mask 12 from a faceplate 10. The sequence of movements is shown in FIGS. 6A through 6E. The faceplate 10 having a shadow mask 12 already attached to it is shown supported in the stud alignment means in FIG. 6A. Plunger 60 travels radially inwardly so that the spring 64 is depressed and stud engagement provision 68 is disengaged from mating provision 56 (FIG. 6B). FIG. 6C shows the mask 12 having been lowered from its previous position by translatable holding means 62. Plunger 60 now moves outwardly, releasing spring 64 and the faceplate 10 is moved upwardly from the stud alignment means (FIGS. 6D and 6E). The mask 12 and faceplate 10 are now separated and may be removed from the apparatus.

In the manufacture of large numbers of faceplates having studs embedded in the corners thereof, slight deviations will occur in the exact location of the studs. Three of the studs will always define a plane, but the fourth stud may or may not be exactly located within that plane. In order to accommodate these nonideal faceplates, the corner assemblies 40, illustrated in FIG. 4, may be used in only three corners of the apparatus shown in FIG. 3. The assembly for the fourth corner has no rollers 52 and the stop 54 is movable in a vertical direction to adjust to the height of the fourth stud of a faceplate. The plunger 60 is referenced the predetermined vertical distance from the stop 54, but also "floats" with the stop 54. The three corner assemblies 40 capture three of the studs on the faceplate, while the fourth assembly adjusts itself to the fourth stud.

The invention is not limited to the particular details of the method depicted and other modifications and applications are contemplated. Certain changes may be made in the abovedescribed method without departing from the true spirit and scope of the invention herein involved. For example, a mask could be placed directly into alignment means and the springs immediately depressed. Then, a faceplate could be placed directly into the stud aligning means and the springs released, engaging the studs. No vertical movement would be necessary. It is intended, therefore, that the subject matter in the above depiction shall be interpreted as illustrative and not in a limiting sense.

I claim:

1. For use in the manufacture of color television picture tubes, a method for attaching a frameless, non-self-rigid, curved shadow or photographic mask to a flangeless, curved faceplate having a concave inner surface with mask support studs extending therefrom in corner regions thereof, said method comprising:

providing on each corner of said mask a leaf-type spring having a stud-engagement provision for retentively engaging a mating provision on one of said studs, and having indexing means separate from said provision;

supporting said mask in a substantially horizontal position;

supporting said faceplate in a substantially horizontal position and with the concave surface of said faceplate facing a convex surface of said mask;

rotationally and translationally aligning said faceplate and said mask by engaging said studs on said faceplate with a stud aligning means such that said mating provisions on said studs lie in a substantially horizontal, predetermined stud reference plane; and by engaging said indexing means on said springs with a spring aligning means such that said stud engagement provisions lie in a substantially horizontal, predetermined spring reference plane, said spring reference plane being spaced a predetermined distance in a substantially vertical direction from said stud reference plane;

depressing said springs with said spring aligning means:

effecting translational relative motion over said predetermined distance between said faceplate and mask assembly such that said stud reference plane and said spring reference plane coincide; and releasing said springs such that said stud-engagement provisions on said springs engage said mating provisions on said studs.

2. The method defined in claim 1 wherein said mask assembly is aligned by engaging a finger with said indexing means, said indexing means being a recess on each of said springs.

3. The method defined in claim 1 wherein said stud engagement provision on one or more of said springs is a protrusion and on the remaining non-protrusion springs is an aperture, and said mating provision on one or more of said studs is an aperture and on said remaining non-aperture studs is a protrusion, said apertures being mated with said protrusions.

4. The method defined in claim 1 wherein said relative motion is effected by raising said mask assembly until said spring reference plane coincides with said stud reference plane.

5. For use in the manufacture of color television picture tubes, a method for attaching a frameless, non-self-rigid, curved shadow or photographic mask to a flangless, curved faceplate having a concave inner surface with four mask support studs extending therefrom in corner regions thereof, said method comprising;

providing on each of the four corners of said mask leaf-type springs having stud engagement provisions for retentively engaging mating provisions on said studs, said stud engagement provisions being apertures on three of said springs and a protrusion on a fourth spring, said mating provision being a protrusion on three of said studs for mating with said springs having apertures, and an aperture on a fourth spring having a protrusion, said springs also having recesses separate from said protrusion and apertures;

supporting said mask in a substantially horizontal position;

supporting said faceplate in a substantially horizontal initial position and with the concave surface of said faceplate facing a convex side of said mask;

rotationally and translationally aligning said faceplate and said mask by lowering said faceplate from said initial position such that each of said studs engages an alignment means so that said mating provisions on said studs lie in a substantially horizontal, predetermined stud reference plane; and by engaging said recesses on each of said springs with fingers such that said stud engagement provisions lie in a substantially horizontal, predetermined spring reference plane, said spring reference plane being spaced a predetermined distance in a substantially vertical direction from said stud reference plane;

depressing said springs with said fingers;

raising said mask in a vertical direction over said predetermined distance until said stud reference plane and said spring reference plane coincide; and releasing said springs such that said-engagement provisions on said springs engage said mating provisions on said studs.

* * * * *